US006199359B1

(12) United States Patent
Hart et al.

(10) Patent No.: US 6,199,359 B1
(45) Date of Patent: Mar. 13, 2001

(54) POSITIONING UNIT FOR A YARN SPLICER

(75) Inventors: Rubin Hart; Maurice Willis, both of Greensboro, NC (US)

(73) Assignee: Cone Mills Corporation, Greensboro, NC (US)

( * ) Notice: Subject to any disclaimer, the term of this patent is extended or adjusted under 35 U.S.C. 154(b) by 0 days.

(21) Appl. No.: 09/239,302

(22) Filed: Jan. 29, 1999

(51) Int. Cl.[7] ..... A47L 9/00

(52) U.S. Cl. ..... 57/22; 15/300.1; 15/319; 15/340.1; 15/340.2; 28/34; 28/173; 57/22; 57/263; 57/264; 57/303; 242/131; 281/34; 281/173

(58) Field of Search ..... 57/22, 263, 264, 57/303; 242/131; 28/34, 173; 15/300.1, 319, 340.1, 340.2; 414/331

(56) References Cited

U.S. PATENT DOCUMENTS 3,575,359 * 4/1971 Furst ..... 242/131
3,753,274 * 8/1973 Koslowski ..... 28/34
4,208,865 * 6/1980 Koella ..... 57/303
4,598,539 * 7/1986 Stahlecker et al. ..... 57/263
4,833,872 5/1989 Czelusniak, Jr. et al. .
5,207,547 * 5/1993 Kawamura ..... 414/331
5,613,643 3/1997 Weiner .
5,683,056 11/1997 Gravitt .

* cited by examiner

*Primary Examiner*—John J. Calvert
*Assistant Examiner*—Shaun R Hurley
(74) *Attorney, Agent, or Firm*—Nixon & Vanderhye P.C.

(57) ABSTRACT

A positioning unit for a yarn splicer mountable to a creel in a yarn winding operation includes a rolling unit attachable to the creel, a main support member secured to the rolling unit, and a slide unit supporting the yarn splicer. The slide unit is slidably mounted to the main support member. In one arrangement, the main support member includes an air cylinder, and the slide unit includes an actuator driven by the air cylinder. In another arrangement, the slide unit is secured to the main support member for manual positioning by a creel attendant and is supported by a counterweight assembly. The positioning unit enables a creel attendant to easily and readily position a mechanical splicer or the like relative to yarn packages on a creel to facilitate yarn package maintenance.

19 Claims, 6 Drawing Sheets

POSITIONING UNIT FOR A YARN SPLICER

BACKGROUND OF THE INVENTION

This invention relates to splicing yarn in a textile operation and, more particularly, to a positioning unit for a mechanical yarn splicer mountable to a creel in a yarn winding operation.

In a typical yarn winding operation, numerous yarn packages are mounted on a rack, a so-called creel. The yarn packages are mounted on the creel in cooperating pairs, with the trailing end of one package being connected to the leading end of the second package for continuous winding of the package pair. The yarn from the packages is collectively guided by the creel to a winding drum, a so-called warp beam.

Conventionally, in order to connect the trailing end of yarn from the first package with the leading end of yarn from the second package on the creel, a creel attendant manually ties the ends together. A similar operation is performed in the event that the yarn should break during winding. This operation is not only time consuming, but also effects a defect in the end product. In another method, the creel attendant uses an adhesive to adhesively splice the yarns together, which is also time consuming and somewhat unreliable.

Air splicers are also known for this purpose but are not widely used because of their bulky nature, high cost and tedious and time-consuming method of operation. In an air splicer, the ends of the yarns to be spliced are arranged within the bore or passageway of the splicer beside each other and facing in opposite directions. The bore is typically open-sided, that is with a slot extending along its length that may have a lid for closing the slot. In operation, pressurized air or the like is directed transversely into the bore to effect entanglement of the fibers or filaments of the ends of the yarn with each other.

An example of an air splicer used for yarn packages in a textile creel is disclosed in U.S. Pat. No. 4,833,872.

There is a need, however, to provide a positioning unit for a yarn splicer that facilitates operator handling and positioning of the splicer. When easily maneuvered and operated, the splicing operation with an air splicer can be performed rapidly and efficiently.

SUMMARY OF THE INVENTION

It is an object of the invention to provide a positioning unit for a yarn splicer mountable to a textile creel in a yarn winding operation that provides an efficient and effective splice for the yarn and is easy for a creel attendant to position relative to the creel and operate.

This and other objects of the invention are achieved by providing a positioning unit according to the present invention. The positioning unit for a yarn splicer mountable to a creel in a yarn winding operation includes a rolling unit attachable to the creel, main support members secured to the rolling unit, and a slide unit supporting the yarn splicer. The slide unit is slidably mounted to the main support member. With the creel extending along a longitudinal direction, the rolling unit includes a rail attachable to the creel and extending in the longitudinal direction and a roller assembly supported by the rail. The main support unit may include an air cylinder, which drives the slide unit actuator vertically therealong relative to the creel. Alternatively, the main support unit is a hollow beam, and the slide unit includes rollers rotatably supported by axles mounted between side plates surrounding the main support. These rollers engage the main support. In order to facilitate positioning of the yarn splicer, the positioning unit includes a pivot extension attached to the slide unit, wherein the yarn splicer is supported by the slide unit via the pivot extension.

To simplify the use and operation of the splicer, the positioning unit may also be provided with a counterweight assembly coupled with the slide unit via a line and pulley. This counterweight assembly is contained in a counterweight conduit, and the main support member includes the counterweight conduit and a beam member slidably supporting the slide unit. The slide unit is preferably provided with a safety catch urged open by the line and closed by a spring. Upon failure of the line, the safety catch is closed into engagement with one of a plurality of apertures in the main support unit.

The yarn splicer is coupled with a pressurized air source via a pressurized air line to drive the splicer. A chain retractor is also secured to the main support, which serves as a guide for an air tube that delivers pressurized air to the yarn splicer.

In accordance with another aspect of the invention, there is provided a positioning unit for a yarn splicer mounted to a creel in a yarn winding operation. The positioning unit includes a main rolling member attachable to the creel for displacement along a longitudinal length of the creel, and a slide unit supporting the yarn splicer. The slide unit is slidably mounted to the main rolling member and is displaceable vertically along the main rolling member relative to the creel. In this arrangement, the main rolling member includes an upper rail attachable to a top portion of the creel and a lower rail attachable to a bottom portion of the creel. The main rolling member preferably further includes a main support member supporting the slide unit and a roller assembly attached to the main support member. The roller assembly engages the upper rail and the lower rail.

The main rolling member preferably includes an air cylinder that drives the slide unit vertically therealong relative to the creel. In this arrangement, the slide unit is operable with the air cylinder using cooperative structure. The slide unit may alternatively be constructed of rollers rotatably supported by axles mounted between side plates surrounding the main support. A counterweight assembly is coupled with the slide unit via a line and pulley. This counterweight assembly is contained in a counterweight conduit, and the main rolling member includes the counterweight conduit and a beam member slidably supporting the slide unit.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
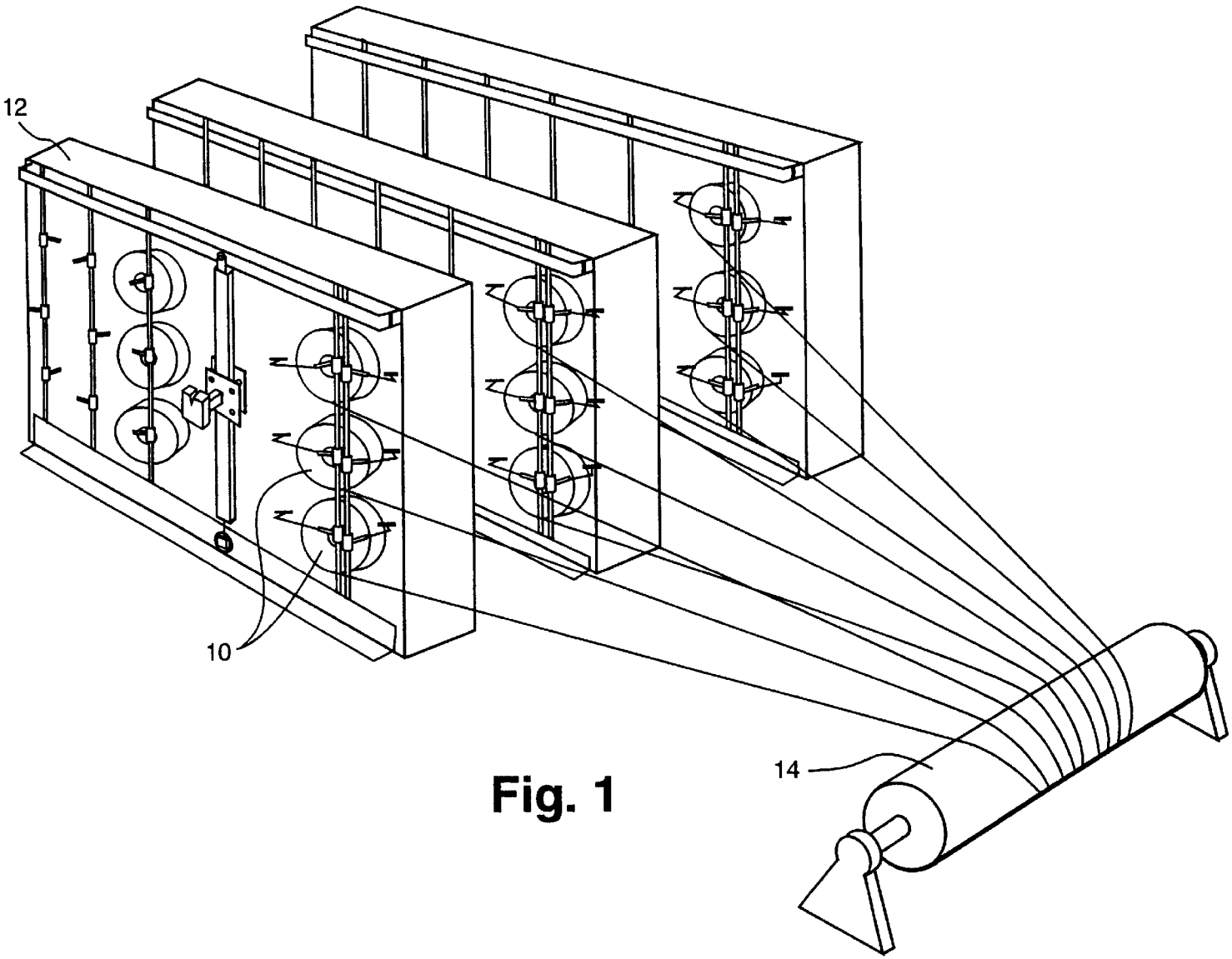
FIG. 1 is a schematic perspective view of a beam warping operation using a creel and the positioning unit according to the present invention.

Referring to FIG. 1, in a beam warping operation, numerous yarn packages 10 are supported on a creel 12, and individual yarns from each of the packages are converged for winding on a drum 14. Typically, the yarn packages 10 are arranged in cooperating pairs with one package being the running package of yarn and the other package serving as a reserve package. The trailing end of yarn from the running package is connected to the leading end of the reserve package using a mechanical splicer. In other instances, depending on the material of the yarn, the filaments may be severed during the winding operation. The severed filaments can be reattached using the splicing mechanism.

Figure 2:
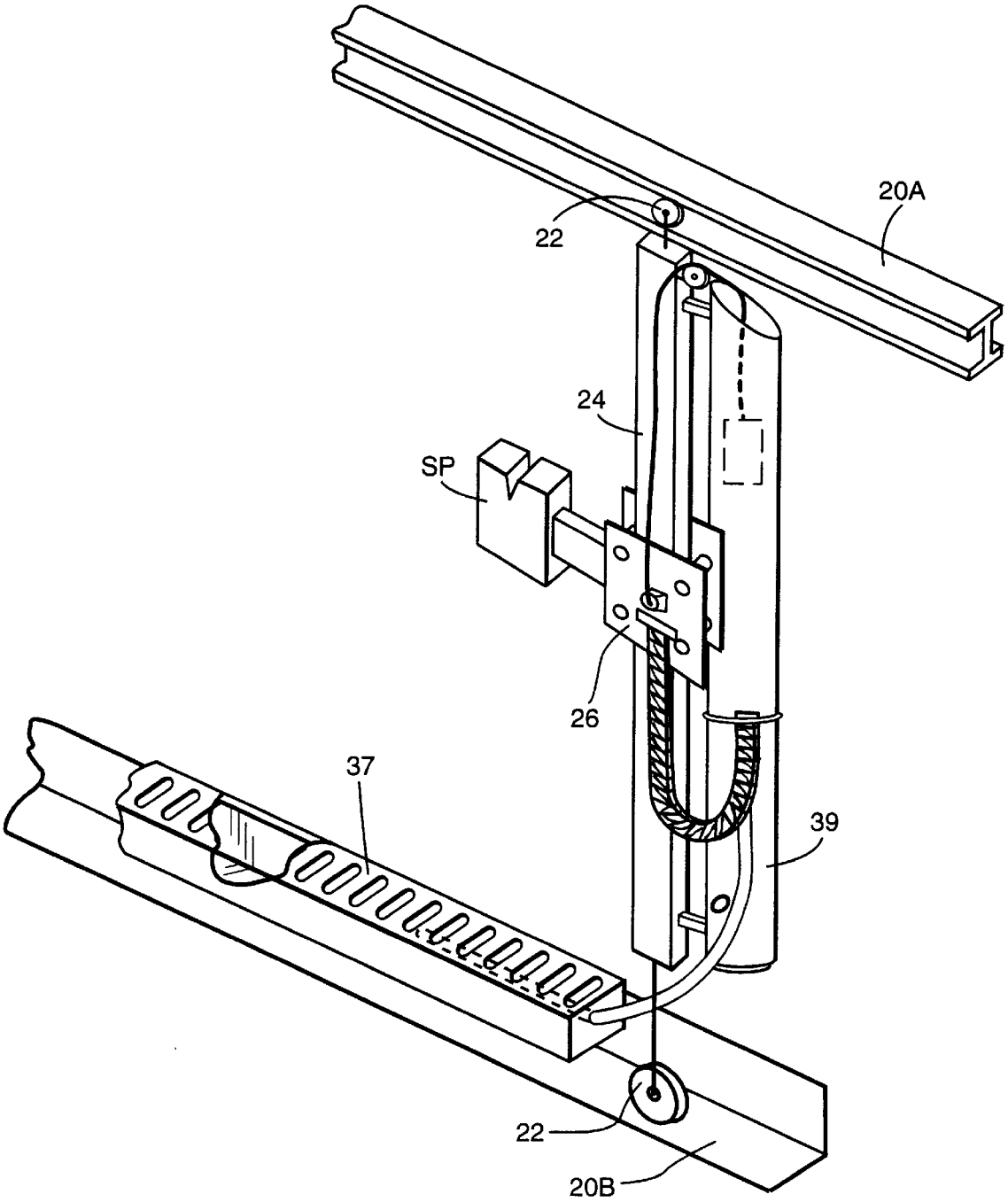
FIG. 2 is a perspective view of the positioning unit according to the present invention.

The mechanical splicer for performing the splicing operation can be heavy and bulky thus making it difficult for the creel attendant to handle. The positioning unit for supporting a mechanical splicer in the context of the present invention is illustrated in FIG. 2. The mechanical splicer itself can be any of several known splicers such as a Twinsplicer, available from Savio-Espero, a company of Italy. The particular mechanical splicer is not pertinent to the subject matter of this invention, and the details thereof will not be described. The invention is thus not meant to be limited to the mentioned Savio splicer.

The positioning unit according to the invention includes a first rail 20A such as an I-beam and a second rail 20B such as an angle bracket attachable to top and bottom portions of the creel 12, respectively. The rolling unit also includes a roller assembly 22 supported by the rails 20A, 20B.

A main support member 24 is secured to the rolling unit 20, 22, and a slide unit 26 is slidably mounted to the main support member 24. The slide unit 26 supports the splicer SP and its components.

Figure 5B:
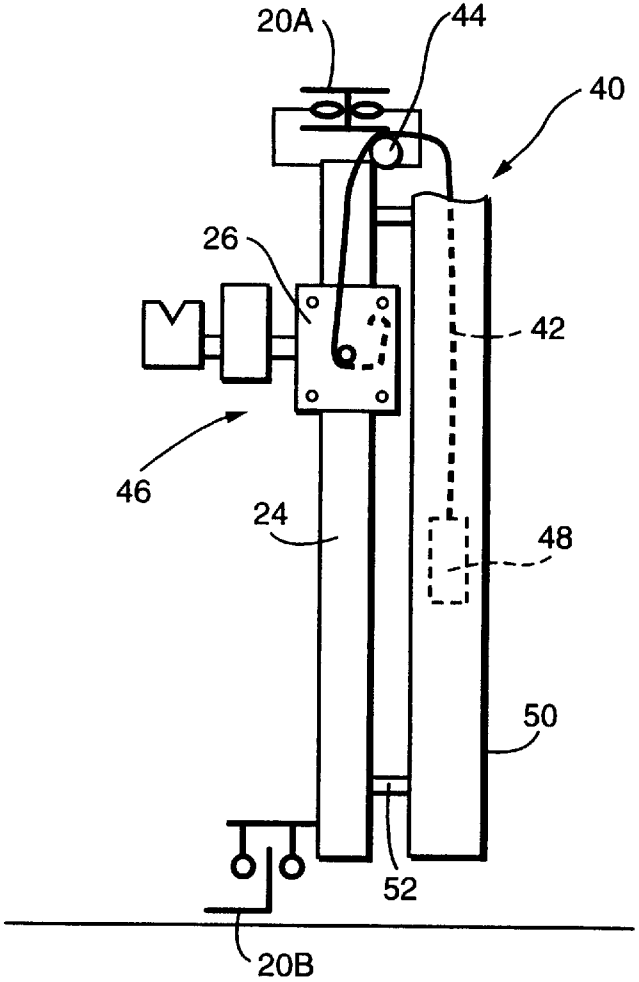
FIGS. 5A and 5B are front views of the positioning unit according to the invention.
Figure 5A:
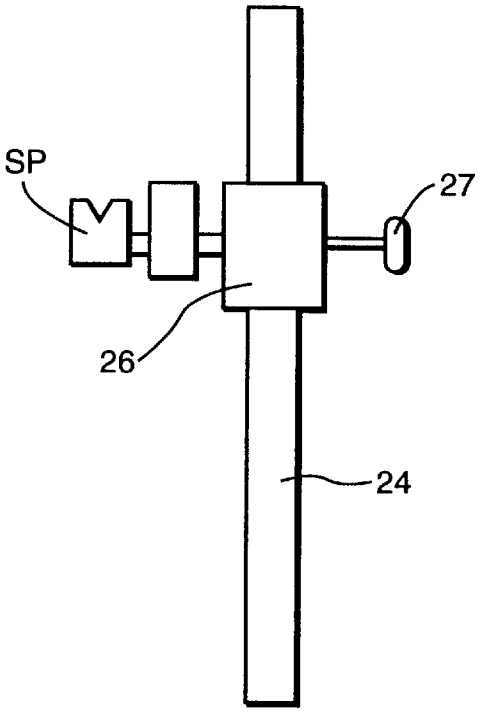

In a first embodiment of the invention, referring to FIG. 5A, the main support member 24 comprises an air cylinder that cooperates with the slide unit 26 to effect selective positioning of the slide unit relative to the main support member 24 using a pneumatic motor. Any suitable cooperating air cylinder and actuator slide unit can be used. An example of a suitable assembly is the Origa Rodless Cylinder available from Applied Industrial Technologies of Greensboro, N.C. and corresponding actuator. In this arrangement, a three-position switch 27 via a suitable valve is manipulated to position and hold the slide unit 26 relative to the creel. A creel attendant can readily position the splicer SP by sliding the main support member 24 via the rolling unit 20, 22 along a longitudinal direction of the creel and then vertically position the splicer by controlling the actuator with the three-position switch 27.

Figure 3:
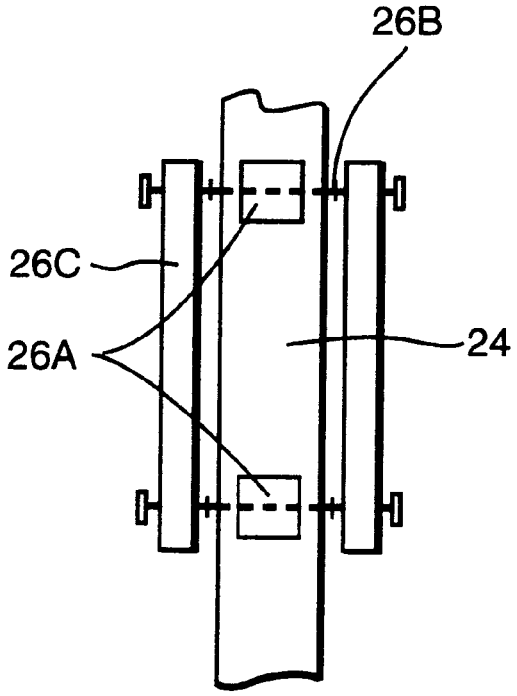
FIG. 3 is a side view of the slide unit according to the invention.
Figure 6:
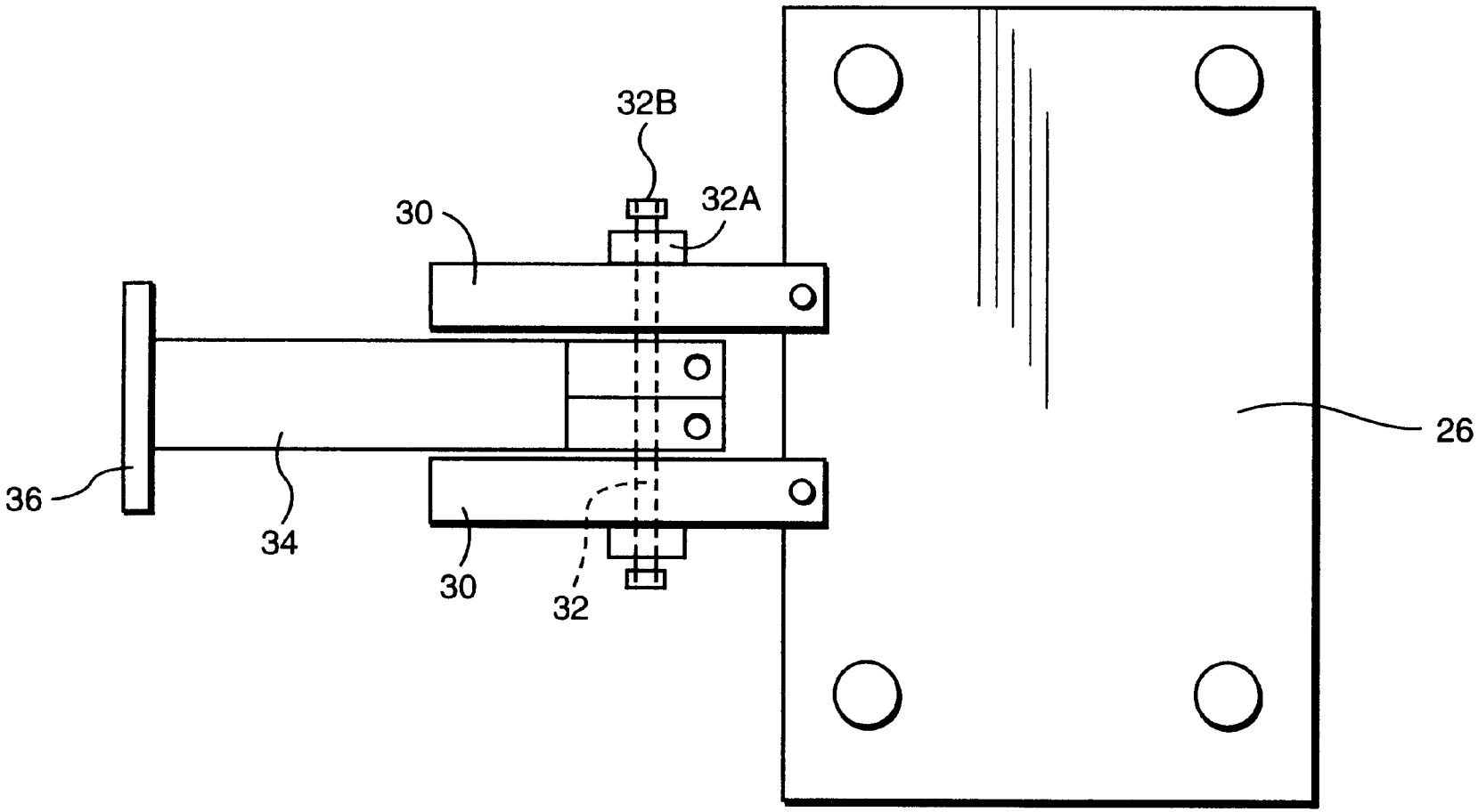
FIG. 6 illustrates the mounting unit for the splicer attached to the positioning unit of the invention.

In an alternative embodiment, the main support member 24 is formed of a hollow beam of sturdy material such as aluminum. In this embodiment, the slide unit 26, with reference to FIG. 3, includes rollers 26A supported by axles 26B mounted between side plates 26C surrounding the main support member 24. The rollers 26A engage a surface of the main support 24. The splicer SP may be secured to the slide unit 26 using any suitable supporting structure. As shown in FIG. 6, in a preferred arrangement, a pair of support brackets 30 are secured to the slide unit 26, and a support axle 32 is extended between the support plates 30 and secured by a spacer 32A and nut 32B that pivotally supports an extension arm 34 sandwiched between the support plates 30 on the support axle 32. A suitable mounting surface 36 for the splicer is disposed at an exterior end of the extension arm 34. This splicer support assembly including the pivoting extension arm 34 facilitates positioning of the splicing mechanism, making the manipulation of the splicing mechanism easier for the creel attendant.

Figure 4:
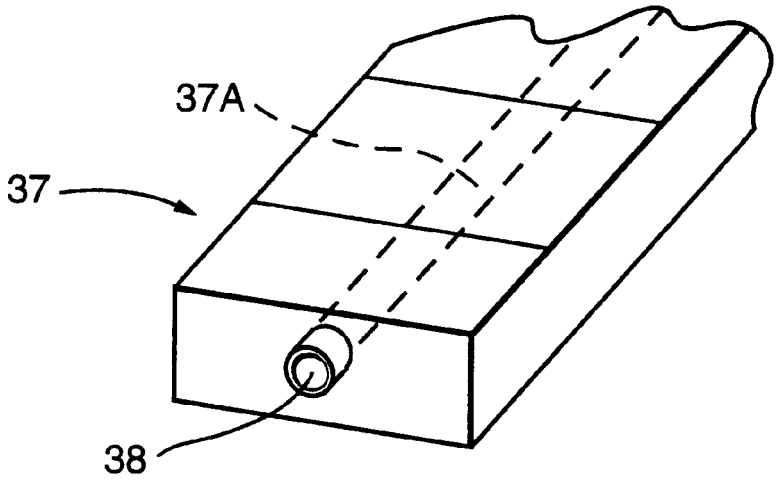
FIG. 4 illustrates the chain retractor including a channel for a source of pressurized air.

With reference to FIGS. 2 and 4, a main chain retractor 37 is attached to the main support member 24 adjacent the second rail 20B of the positioning unit and extends along the length of the creel 12. As the main support member 24 is displaced along the creel 12, the chain retractor folds over itself The chain retractor 37 includes a channel 37A that receives an air tube 38 or the like, which is coupled with a source of pressurized air. An air splicer requires pressurized air for operation, and the chain retractor 37 serves to deliver the pressurized air to the splicer SP via the air tube 38, while protecting the air line. In the first embodiment of the invention, the pressurized air can also be accessed to drive the air cylinder that cooperates with the slide unit 26. The air tube is guided to a secondary chain retractor 39 that is attached between the slide unit 26 and a counterweight conduit 50 (described below). The secondary chain retractor 39 guides the air tube to the splicer and protects the air line during use.

Referring to FIG. 5B, in this embodiment, a counterweight assembly 40 is coupled with the slide unit 26 via a line 42 and pulley 44. The line 42 is secured at one end to a safety latch assembly 46 (described below) and at its other end to a counterweight 48. The weight of the counterweight 48 is selected to be substantially equal to the collective weight of the slide unit, splicing mechanism and any components. The pulley 44 is preferably secured at the top of the main support member 24 near the I-beam 20A of the rolling unit 20. A counterweight conduit 50 is secured adjacent the main support member 24 by brackets 52 or the like, and the pulley 44 guides the counterweight 48 and line 42 within the counterweight conduit 50. With this arrangement, vertical movement of the slide unit along the main support member 24 is facilitated.

Figure 7:
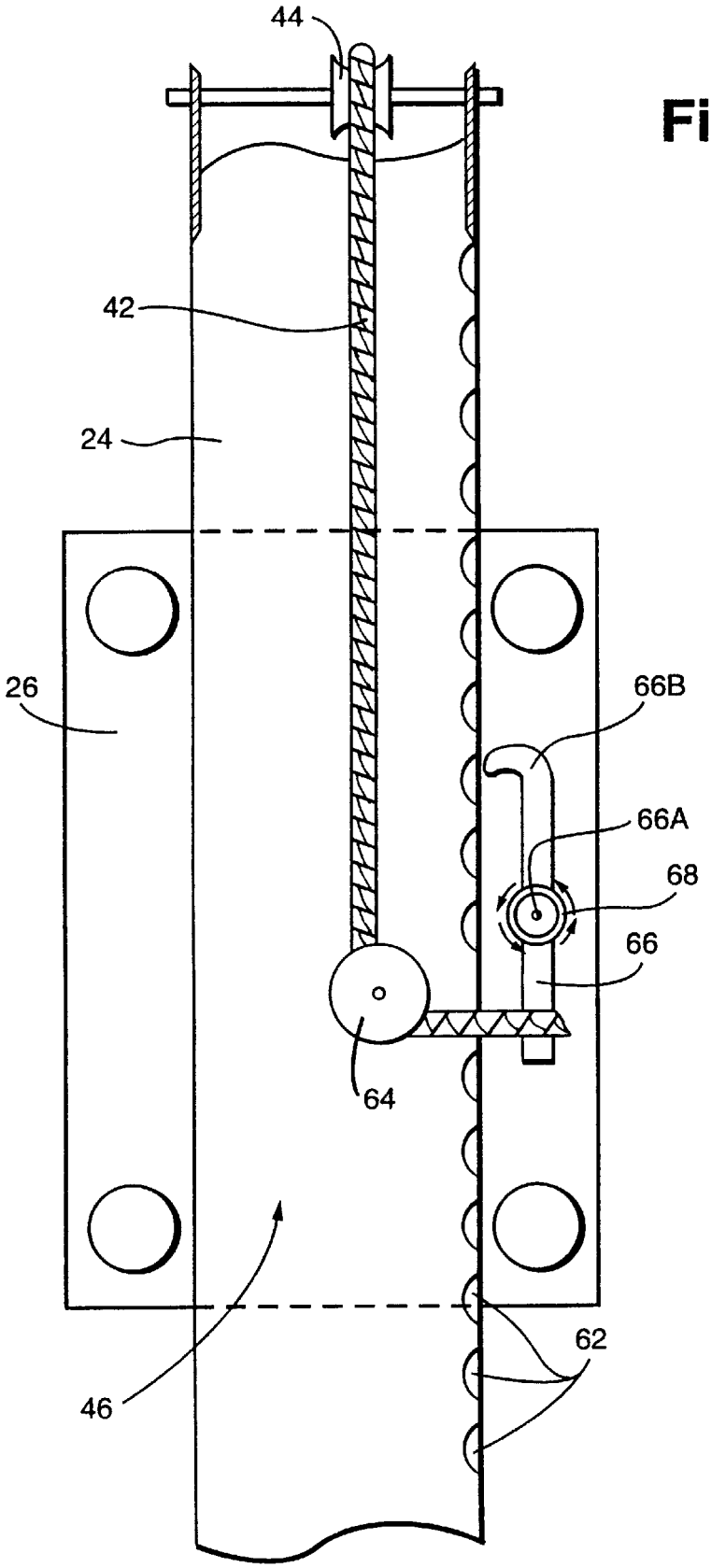
FIG. 7 illustrates the safety catch assembly according to the invention.

FIG. 7 illustrates the safety catch mechanism 46 for the counterweight assembly 40. In the event that the line 42 is severed, without a safety catch mechanism, the counterweight 48 and the slide unit 26 and components would fall rapidly to the ground causing a safety risk for the creel attendant and the equipment. To prevent this occurrence, the main support member 24 is provided along one side thereof with a plurality of apertures 62. The line 42 is guided across a safety latch pulley 64 and secured to an end of a safety latch 66. The safety latch 66 is pivotally secured to the slide unit 26 at a pivot point 66A and biased toward engagement with the apertures 62 (counterclockwise in FIG. 7) by a leaf spring 68 or the like. The safety latch 66 is provided with a latching hook 66B at an end opposite the line connecting end for engaging the apertures 62 in the main support unit 24. In the event that the line 42 is severed during operation, the counterweight 48 will fall to the bottom of the counterweight conduit 50, and the slide unit will begin falling down the main support member 24. When tension on the line 42 is released, however, the spring 68 will drive the safety latch 66 toward engagement with the apertures 62 in the main support member 24. The hook portion 66B of the safety latch 66 will thus catch in one of the apertures 62 and prevent the slide unit 26 from falling to the ground.

With the positioning unit according to the present invention, a main support member can be readily and controllably moved along a longitudinal axis of a creel by virtue of a longitudinally extending roller unit. A slide unit is readily vertically slidable along the main support member to position a mechanical splicer in a desired position adjacent respective yarn packages for splicing. In one arrangement, an air cylinder drives the slide unit vertically along the main support member. In another arrangement, the slide unit is moved manually by a creel attendant and is supported with a counterweight assembly. With this structure, a splicer can be easily and readily positioned to a desired position to facilitate creel attendant operation.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A positioning unit for a yarn splicer mountable to a creel in a yarn winding operation, the positioning unit comprising:

a rolling unit attachable to the creel;

a main support member secured to the rolling unit; and a slide unit supporting the yarn splicer, the slide unit being slidably mounted to the main support member for vertical displacement relative to the creel.

2. A positioning unit according to claim 1, wherein the creel extends along a longitudinal direction, and wherein the rolling unit comprises a rail attachable to the creel and extending in the longitudinal direction and a roller assembly supported by the rail.

3. A positioning unit according to claim 1, wherein the main support member comprises an air cylinder, the air cylinder driving the slide unit vertically therealong relative to the creel.

4. A positioning unit according to claim 1, wherein the slide unit comprises rollers rotatably supported by axles mounted between side plates surrounding the main support, the rollers engaging the main support.

5. A positioning unit according to claim 1, further comprising a pivot extension attached to the slide unit, the yarn splicer being supported by the slide unit via the pivot extension.

6. A positioning unit according to claim 1, further comprising a counterweight assembly coupled with the slide unit via a line and pulley.

7. A positioning unit according to claim 6, wherein the counterweight assembly is contained in a counterweight conduit, and wherein the main support member comprises the counterweight conduit and a beam member slidably supporting the slide unit.

8. A positioning unit according to claim 6, wherein the slide unit comprises a safety catch urged open by the line, the safety catch being biased closed by a spring, wherein upon failure of the line, the safety catch is closed into engagement with one of a plurality of apertures in the main support member.

9. A positioning unit according to claim 1, wherein the slide unit comprises a plurality of bearings disposed between side plates surrounding the beam member.

10. A positioning unit according to claim 1, further comprising a pressurized air line coupled with a pressurized air source at one end and with the yarn splicer at an other end.

11. A positioning unit according to claim 1, further comprising a chain retractor secured to the main support member, the chain retractor serving as a guide for an air tube that delivers pressurized air to the yarn splicer.

12. A positioning unit for a yarn splicer mountable to a creel in a yarn winding operation, the positioning unit comprising:

a main rolling member attachable to the creel for displacement along a longitudinal length of the creel; and a slide unit supporting the yarn splicer, the slide unit being slidably mounted to the main rolling member and being displaceable vertically along the main rolling member relative to the creel.

13. A positioning unit according to claim 12, wherein the main rolling member comprises an upper rail attachable to a top portion of the creel and a lower rail attachable to a bottom portion of the creel.

14. A positioning unit according to claim 13, wherein the main rolling member further comprises a main support member supporting the slide unit and a roller assembly attached to the main support member, the roller assembly engaging the upper rail and the lower rail.

15. A positioning unit according to claim 12, wherein the main rolling member comprises an air cylinder, the air cylinder driving the slide unit vertically therealong relative to the creel.

16. A positioning unit according to claim 12, further comprising a counterweight assembly coupled with the slide unit via a line and pulley.

17. A positioning unit according to claim 16, wherein the counterweight assembly is contained in a counterweight conduit, and wherein the main rolling member comprises the counterweight conduit and a beam member slidably supporting the slide unit.

18. A positioning unit for a yarn splicer mountable to a creel in a yarn winding operation, the positioning unit comprising:

a rolling unit attachable to the creel;

a main support member secured to the rolling unit; and a slide unit supporting the yarn splicer, the slide unit being slidably mounted to the main support member, wherein the slide unit comprises rollers rotatably supported by axles mounted between side plates surrounding the main support, the rollers engaging the main support.

19. A positioning unit for a yarn splicer mountable to a creel in a yarn winding operation, the positioning unit comprising:

a rolling unit attachable to the creel;

a main support member secured to the rolling unit;

a slide unit supporting the yarn splicer, the slide unit being slidably mounted to the main support member; and a pivot extension attached to the slide unit, the yarn splicer being supported by the slide unit via the pivot extension.

* * * * *

UNITED STATES PATENT AND TRADEMARK OFFICE

CERTIFICATE OF CORRECTION

PATENT NO. : 6,199,359 B1
DATED : March 13, 2001
INVENTOR(S) : Hart et al.

It is certified that error appears in the above-identified patent and that said Letters Patent is hereby corrected as shown below:

Title page,
Delete "[75], Inventors: Rubin Hart; Maurice Willis, both of Greensboro, NC (US)" and insert therefor -- [75], Inventor: Reuben Hart; Maurice Willis, both of Greensboro, NC (US) --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*